United States Patent [19]

Raabe

[11] 4,157,594

[45] Jun. 12, 1979

[54] ROLLER CHAIN PLIER

[76] Inventor: Vern J. Raabe, 13819 NE. 73 Pl., Redmond, Wash. 98052

[21] Appl. No.: 879,068

[22] Filed: Feb. 21, 1978

[51] Int. Cl.[2] ..... B25B 7/22

[52] U.S. Cl. ..... 7/125; 59/7; 81/425 R; 81/5.1 R

[58] Field of Search ..... 7/125; 29/268; 59/7; 81/425 R, 425 A, 5.1 R

[56] References Cited

U.S. PATENT DOCUMENTS

| | | | |
|---|---|---|---|
| 2,986,870 | 6/1961 | Blais | 59/7 |
| 3,063,236 | 11/1962 | Cannon | 59/7 |
| 3,156,087 | 11/1964 | Granberg | 59/7 |
| 3,250,450 | 5/1966 | LePage et al. | 7/125 X |
| 3,647,186 | 3/1972 | Hartman | 81/425 R X |

*Primary Examiner*—James L. Jones, Jr.
*Assistant Examiner*—James G. Smith

[57] ABSTRACT

A compound plier type tool with elongate jaws configured as a chain chuck to move and hold the ends of a roller chain together for fastening by a link pin. The inner portions of the jaws provide cooperating pin and anvil structures to remove link pins from a roller chain. A species provides plural anvils for use with different sized chains.

7 Claims, 7 Drawing Figures

ROLLER CHAIN PLIER

BACKGROUND OF INVENTION

RELATED APPLICATIONS

There are no applications related hereto now filed in this or any foreign country.

FIELD OF INVENTION

My invention relates generally to a compound plier type tool configured to act as both a chain chucker and link pin extractor for roller chains.

DESCRIPTION OF PRIOR ART

The roller chain has become established in the mechanical arts as a common means of transmitting motion between two opposed cooperating sprockets. To accomplish this function an endless chain ordinarily is required and this requirement necessitates establishment and disconnection of such chains in place on machinery and about sprockets.

To disconnect the common endless roller chain it is necessary to remove a link pin generally with pinned ends extending between adjacent links. Various pin removal or chain breaking tools to accomplish such purposes have heretofore become known. To reestablish an endless chain with appropriate tension in place between two sprockets it is necessary to bring the chain ends into aligned adjacency, normally with some force, to reinsert a link pin. Again various chain chucker tools have heretofore become known for this purpose. The instant invention provides a plier type tool combining the functions of both a chain breaker and a chain chucker. Its novelty does not reside with either of the functions per se, but rather only in the combination of the functions in a particular compound plier type tool with the particular chain chucker and pin extractor structure disclosed.

Since some substantial force is ordinarily required to establish a roller chain in place with common tension, a chain chucker to be operative must be capable of exerting such force and this requirement has generally caused to be evolved some type of compound leverage tool generally of the ratchet, claw or scissor type. Link pin extractors on the other hand commonly have required exertion of less force to extract a link pin and generally have been formed as a simple lever type tool, though compound levers have become known in such devices. The instant invention combines the force of the compound lever with the simplicity of a simple lever in a single tool of a particularized structure that provides both functions in a efficient manner.

The jaws of my particular plier are usually elongate with a chain chuck in their outer end parts, to provide a wide throw for the device to operate through but yet create sufficient force to accomplish the purposes of the chucker. The jaw dimension allows establishment of the pin extractors inwardly of the chuck and closer to the pivotable axis of the jaw to allow exertion of an appropriate force necessary to extract pins with heavily riveted heads. My particular plier provides a locking action which exerts substantial force through the range of jaw motion but yet allows adjustment of the final positioning of the jaws to a fine degree and when locked in that final position maintains it without any additional force from an operator, all to make the alignment of chain parts for reconnection by a link pin a most simple and convenient operation. The instant invention differs from the prior art in providing a tool embodying all of these features in combination, with each so particularized that it is operative with the others to provide functions in the combination that are greater than the total of the functions provided by these elements individually.

SUMMARY OF INVENTION

My invention provides generally a plier type tool having elongate jaws with a chain chuck in the outer part and a pin extractor in the inner part outwardly adjacent the pivot.

The plier body is of the compound lever type having means for adjustment of the gap between the jaws when in closed position. The jaws of the device are more elongate than in the common plier and formed to withstand more substantial force.

The adjacent surfaces of the outer portions of the plier jaws are configured with indentations to receive a portion of a chain link to serve as a chuck to pull two adjacent links together. The medial portion of the lower plier jaw carries a removal pin biased to an inward position but movable by the other plier jaw a limited distance outwardly and into an anvil structure carried in the lower or outer surface of the lower plier jaw. The anvil structure supports a roller chain link so that upon extensive motion of the removal pin the chain pin associated with the supported chain link is disengaged by forcing it from one side of that link so that the pin may be manually removed to disconnect the adjacent chain links.

A species of the invention provides plural differently sized anvils to make a single toole usable with differently sized roller chains.

In creating such a tool it is:

A principal object of my invention to provide in a single tool the functions of a roller chain link pin remover and a fastening device or chain chucker.

A further object of my invention to provide such a tool formed as a compound lever plier with adjustable spacing of closed jaws to permit creation of substantial forces by simple manipulation that will allow and maintain accurate alignment of chain ends for connection.

A further object of my invention to provide such a tool with elongate jaws that creates a relatively large initial span to allow the tool to operate over a substantial distance in closing a chain.

A further object of my invention to provide such a tool with the removal pin adjacent the pivot point of the plier jaws to allow the exertion of substantial forces, if required, especially as in removal of riveted head link pins from a roller chain.

A further object of my invention to provide such a tool that is of new and novel design, of rugged and durable nature, of simple and economic manufacture and one otherwise well adapted to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being illustrated in the accompanying drawings, as is required.

BRIEF DESCRIPTION OF DRAWINGS

In the accompanying drawings, which form a part hereof and wherein like numbers of reference refer to similar parts throughout.

DESCRIPTION OF THE PREFERRED EMBODIMENT

Figure 1:
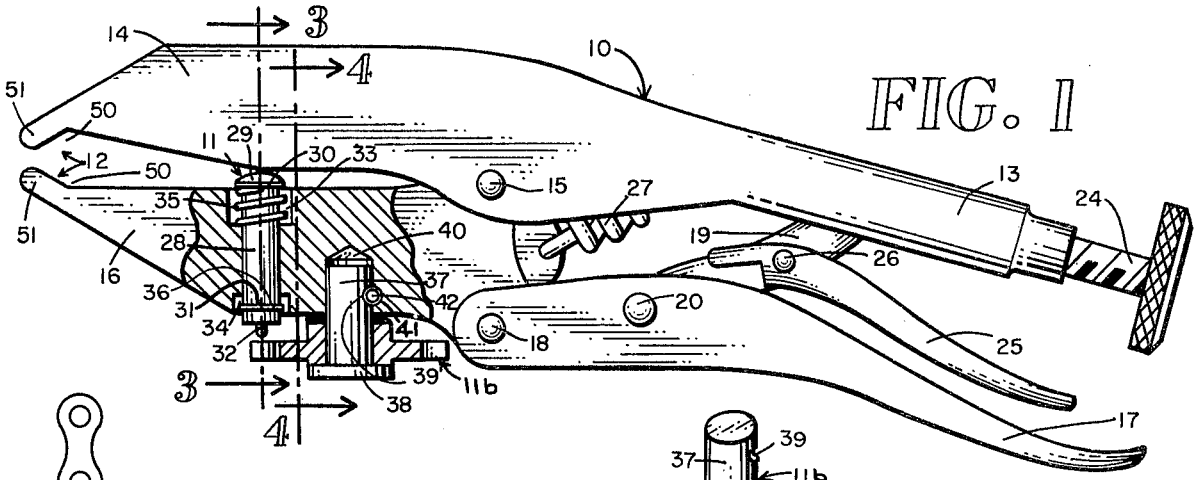
FIG. 1 is an orthographic side view of my invention showing in general its various parts, their configuration and relationship, and having a part of the lower jaw cut away to show particularly the removal pin and anvil structures.

My invention generally provides compound plier structures 10 having elongate jaws providing in their medial part chain pin extractor 11 and in their outer part chain chucker 12.

Plier 10 has upper handle 13 structurally, rigidly communicating with upper jaw 14 which in turn pivotably communicates by jaw pin 15 with lower jaw 16. The lower jaw in turn pivotably communicates with lower handle 17 by handle pin 18 extending therebetween. Jaw gap adjustment lever 19 pivotably communicates from adjustment pin 20 carried in the medial part of the lower handle to fastening pin 22 pivotably extending therethrough from structual support in fastening dog 23 slidably carried within adjustment channel 21 defined in the rearward portion of the upper handle to slidably maintain the fastening dog. Adjustment screw 24 is threadedly engaged in the rearward portion of upper handle and extends into adjustment channel 21 to there contact the rearward portion of adjustment arm fastening dog 23 carried in that channel. This adjustment screw has some length so that by manual adjustment it appropriately regulates the distance between the plier jaws when in closed condition. Opening lever 25 is the elongate, somewhat curved structure illustrated in FIG. 3, pivotably supported in the medial part of adjustment lever 19 by opening lever pin 26 with the longer portion of the opening lever rearwardly of the pin and the shorter portion forwardly thereof to be manipuable to aid the opening of the jaws from a closed condition. Extension spring 27 extends from communication with the medial portion of upper handle 13 to the rearward part of lower jaw 16 somewhat below its pivotable joinder with the upper jaw, to bias the plier to a new condition.

A plier of this type is closed by moving the handles toward each other and opening by moving them away from each other in the normal fashion, but the leverage is multiplied over the simple plier by reason of the offset between the pivot point of the two jaws and that of the lower jaw and handle. Similarly the distance between the jaws when in closed position as illustrated in FIG. 1, is regulated within limits by manipulation of the adjustment screw. Opening of the device from a closed condition, especially when closed with some force, may be aided by motion of opening lever 25 to cause the lower handle initially to move from its closed position with the opening thereafter aided by the bias of spring 27. All of the structure, in its essence at least, has heretofore become known in the plier arts and is not new per se.

Both upper and lower jaws 13, 14 are somewhat more elongate than the jaws of an ordinary plier, in my invention having ideally a length of approximately 4 inches from jaw pin 15 to the outer end part of the jaws. This allows the jaws in their end parts to have a greater throw when they are open than would a jaw of shorter dimension but also creates greater forces on the jaws which requires a heavier construction, stronger materials or both to withstand these forces and maintain appropriate rigidity.

Chain pin extractor 11 comprises extractor pin structure **11*a* and cooperating anvil structure 11*b*** both carried by the lower jaw of the plier in a medial position outwardly of the pivotable joinder of the jaws.

Figure 3:
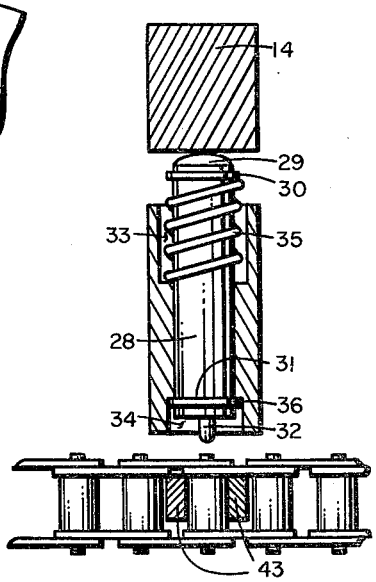
FIG. 3 is a cross-sectional view of the device of FIG. 1 taken on the line 3—3 thereon in the direction indicated by the arrows to show the removal pin structure with a roller chain in dotted outline to show its relationship.

Extractor pin structure **11*a* as seen in FIGS. 1 and 3 provides elongate extractor pin cylinder 28, having rounded top 29, enlarged annular spring boss 30 immediately therebelow, annular fastening snap ring channel 31 in its lower medial part and diametrically smaller cylindrical extractor pin 32 in its lowermost part. The extractor pin structure is movably carried in a cylindrical hole in plier lower jaw 16 defined with medial part slightly larger than extractor pin cylinder 28 to provide a slidable fit therefore, and larger upper and lower portions 33, 34 to receive spring 35 and snap ring 36** respectively.

Spring 35 is a cylindrical compression spring having an internal diameter slightly larger than that of the extractor pin cylinder and an external diameter substantially the same as spring boss 30 to bias the extractor pin cylinder to a forwardmost position. Snap ring 34 is adapted to releasably fit in snap ring channel 31 of the extractor pin cylinder to maintain the extractor pin structure in the lower plier jaw.

Anvil structure 11B as seen in FIG. 1 provides cylindrical anvil mounting pin 37 having enlarged head 38 in its lowermost part and fastening screw groove 39 in its upper medial periphery. The anvil mounting pin is carried in anvil mounting pin hole 40 defined in the lower medial portion of lower plier jaw 16 in such position as to operatively position the anvil disk relative the extractor pin structure. Threaded fastening hole 41 is defined in the plier lower jaw, perpendicular to the anvil mounting pin hole, to cooperate with the fastening screw groove in the anvil mounting pin to threadedly receive fastening screw 42 to releasably fasten the anvil mounting pin it its hole.

Figure 4:
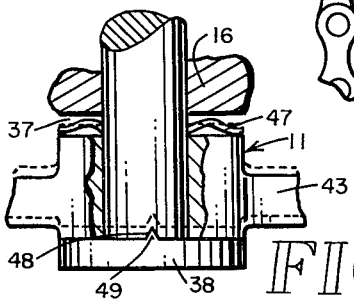
FIG. 4 is a cross-sectional view of the device of FIG. 1 taken on the line 4—4 thereon in the direction indicated by the arrows to show the structure and operation of the anvil; a second position of the anvil is shown in dotted outline to illustrate its motion.
Figure 2:
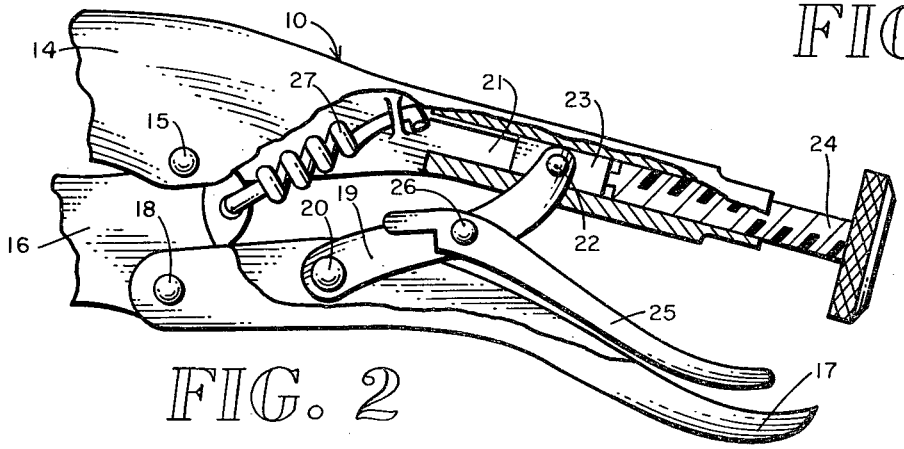
FIG. 2 is a similar orthographic side view of the device of FIG. 1 with the handle structure partially cut away to show the detailed structure and operation of the compound levers of the plier.

Multiple anvil 43 is a disk like structure with thinner peripheral portion defining plural half circular anvil holes 44 all having concentric centers but different sizes to accept different sized chain rollers. Peripheral lips 45 of each anvil must be of appropriate size to fit between adjacent rollers of a roller chain to be serviced to allow sufficient support of a roller in the anvil. The thicker inner portion of the multiple anvil provides a mounting hole that defines circular hole 46 to rotatably mount upon the lower portion of the anvil mounting pin immediately above its head. Annular spring washer 47 fits about the anvil mounting shaft between the mounting hole of the multiple anvil and the adjacent lower plier jaw to bias the multiple anvil away from the lower plier jaw and toward the head of the anvil mounting pin. The spring of the washer allows motion of the anvil toward the plier for rotation when its bias is overcome as shown especially in FIG. 4.

The lower surface of the multiple anvil hub defines plural indentations 48, each radially aligned with an anvil hole 44 to cooperate with interfitting protuberances 49 defined on the upper surface of anvil pin head 38 to releasably align the multiple anvil with the anvil pin and thusly with the plier jaws.

Figure 6:
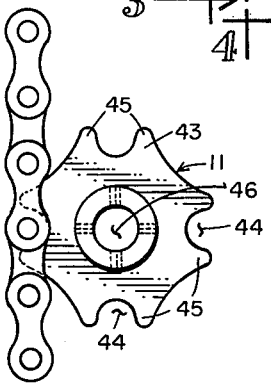
FIG. 6 is a top orthographic view of the multiple anvil of my device with a roller chain shown in dotted outline to illustrate its positioning in the anvil.

The sizing of the extractor pin structure is such that as plier jaws 14, 16 are closed the upper jaw will force the extractor pin cylinder toward and through the lower plier jaw a discrete distance, commonly $\frac{1}{4}$ to $\frac{1}{2}$ inch, against its bias. The anvil structure is sized and positioned so that extractor pin 32 is centered over the anvil hole 46 that is under it with the anvil pin a spaced distance thereabove when in relaxed normally biased condition to allow insertion of a roller chain in the anvil hole with the chain side above the anvil and the extractor pin immediately above the chain pin to be extracted as shown particularly in FIG. 6.

Figure 7:
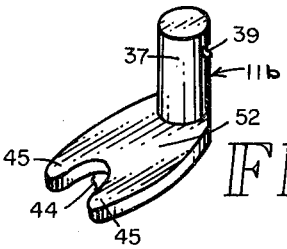
FIG. 7 is an isometric view of a species of anvil that may be used with my invention to support a single size of roller chain.
Figure 5:
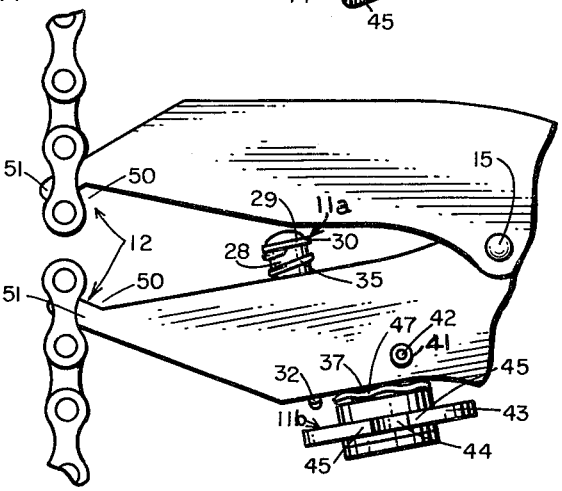
FIG. 5 is a partial view of the jaws of my plier carrying the ends of a roller chain to show their chucking operation.

A specie of single anvil is illustrated in FIG. 7. This form of anvil structure provides the same anvil mounting pin 37 as the primary species of anvil and the pin fits in the same mounting structure 40, 41 defined in the lower plier jaw as heretofore specified. In this specie, however, the anvil 52 is an elongate structure rigidly fastened to the lower end part of the anvil mounting pin. The anvil in its outward portion defines a single circular anvil hole 46 of a particular size. In essence the single anvil species comprises a rigidly mounted sector of the multiple anvil. The species of anvil has no moving parts and is probably somewhat more rigid and durable and cheaper of manufacture because of this but the species is not so convenient as the readily changeable multiple anvil of the principal species. Obviously the single anvil may be removed and another reestablished in a particular plier if desired and a plurality of such single anvils having different sizes of roller links may be used with a single plier.

Chain chucker 12 is formed in the outer portion of jaws 14, 16 immediately inwardly adjacent their ends. The chucker comprises opposed, cooperating indentations 50 defined in the adjacent facing surfaces of the two jaws and positioned directly opposite each other. The size and shape of the chucker channels is not critical because of the general geometry and mechanics of the structures involved and one size may accommodate several sizes of chain, but fit within reasonable limits should be provided to eliminate unnecessary mechanical strain and wear. The size of the endparts of the jaws is somewhat critical, however, as it must be such as to allow those endparts to fit between adjacent rollers of a chain to be serviced and allow those rollers to be carried in indentations 50. A configuration of endparts 51 such as illustrated has been found ideal for this purpose.

The use of my tool may be understood in view of the foregoing specification of its structure.

To disconnect one link from another in a roller chain it is necessary to remove a cylindrical link pin communicating between parts of two adjacent links. Sometimes the heads of these pins may be pinned or riveted to maintain them in place.

To remove a particular link pin an anvil of appropriate size is positioned operatively under the extractor pin. In the principal species of multiple anvil tool the anvil is moved against its bias toward the supporting lower plier jaw and simultaneously rotated until the correct anvil is properly positioned. The chain roller carrying the link pin to be removed is then positioned as in FIG. 3 with one side of the chain link above and supported on the anvil and the roller positioned in the roller hole of that anvil. With the chain so positioned the link pin to be removed will be immediately below the removal pin. With the tool and chain in this position the plier is closed so that its jaws move together, and in so doing the top of the extractor pin will be contacted by the upper plier jaw and moved downward relative the lower plier jaw to force the chain link pin therebelow from engagement in one side of the roller chain links, since those links are supported on the anvil and cannot move with the link pin. If the link pins be headed to any substantial degree, this operation may require some substantial force. After one end of the link pin is disengaged, the pin can then normally be fully removed by manual manipulation, but if not one end of the pin will project from the chain side and can be easily grasped by mechanical devices for forceful removal.

To use the chucker in aligning the ends of a chain for fastening, the chain is established in placed and the two end links positioned with their endmost rollers in indentations 50 with the plier open. Adjustment screw 24 is then manipulated to allow appropriate distance between the two jaws to align the parts for fastening when closed, if this has not been previously done, and the plier is then closed to appropriately align the end links so that a link pin may be inserted therebetween to fasten them to form a continuous chain.

It should be particularly noted from the foregoing description that my tool may be conveniently used to extract a link pin from an endless roller chain when the chain is in position for use upon some machine as well as from a chain not so positioned. It is also to be noted that my tool will exert sufficient force to remove most headed type link pins.

Obviously the multiple anvil of my invention may be configured with a varying number of anvil roller holes depending upon particular sizes of chains to be serviced, tool dimensioning and design. One size of anvil roller hole may also service more than one size of chain roller, but for maximum tool durability and strength a reasonably good fit of roller in anvil roller hole should be maintained.

Commonly one size of extractor pin, that is not larger in diameter than the smallest link pin to be serviced, will service all sizes of chains accommodated by a single tool. Obviously, if desired, however, the extractor pin might be formed separately from the extractor pin cylinder and releasably fastened thereto by a threadedly engaged portion or otherwise to provide for changeable pins, if required.

The foregoing description of my invention is necessarily of a detailed nature so that a specific embodiment of it may be set forth as required, but it is to be understood that various modifications of detail, rearrangement and multiplication of parts might be resorted to without departing from its spirit, essence or scope.

Having thusly described my invention, what I desire to protect by Letters Patent, and what I claim is:

1. A roller chain chucking and link pin removing tool comprising, in combination:

a compound plier having an elongate unitary upper jaw and upper handle pivotably communicating with the upper medial part of a lower jaw having a pivotably joined lower handle, the pivotal joinder of the lower jaw and lower handle being at a spaced distance from the pivotal joinder of the jaws with each other, and means of adjustably regulating the distance between plier jaws when closed;

a link pin extractor having an elongate extractor cylinder movably carried, in a hole defined in the medial part of the lower jaw, for limited sliding motion in a plane parallel to that of the plier motion and movably responsive to motion of the upper plier jaw with an extractor pin carried in the outer end of the pin extractor most distal from the upper plier jaw;

means of biasing the link pin extractor to an inward position toward the upper lier jaw; and means of releasably maintaining the link pin extractor within the lower plier jaw;

an anvil having at least one chain roller hole to receive and support the roller and associated links of a roller chain, the anvil being carried by an anvil mounting pin, releasably carried by the lower plier jaw, at a spaced distance from the pin extractor so that the chain roller holes are positionable with centers immediately under the pin extractor when that pin extractor be in relaxed biased position; and a chain chucker in the outer end parts of the plier jaws, having indentations at similar opposed positions in the facing sides of the jaws to receive rollers at the end parts of a roller chain to be connected and force spaced links between the rollers into adjacency to allow their interconnection by a link pin responsive to plier motion.

2. The invention of claim 1 wherein the anvil is further characterized by:

an elongate foot extending from structural communication with the lowermost part of the anvil mounting pin radially outwardly therefrom with a single roller hole defined in the end part of the elongate foot.

3. The invention of claim 1 wherein the anvil is further characterized by:

a multiple anvil disk having plural roller holes defined in spaced relationship about its periphery with the centers of each hole concentric about the anvil disks;

the multiple anvil disk being rotatably carried on the anvil mounting pin so that each roller hole defined therein may be rotated to an operative with its center immediately below the relaxed pin extractor; and means of biasing the multiple anvil disk to any one of plural positions each with an anvil chain roller hole operatively centered immediately below the relaxed pin extractor.

4. A roller chain chucking and link pin removal tool comprising, in combination:

a compound plier having an elongate unitary upper jaw and upper handle pivotably communicating in the medial part with a lower jaw having a pivotably joined lower handle, the pivotal joinder of the lower jaw and lower handle being of a spaced distance from the pivotal joinder of the jaws with each other, and means of adjustably regulating the distance between the plier when closed;

a link pin extractor having an elongate pin extractor cylinder movably carried, in a hole defined in the medial part of the lower plier jaw, for limited sliding motion in a plane parallel to that of plier motion and movably responsively to motion of the upper plier jaw with;

an extractor pin carried in the outer end of the pin extractor most distal from the upper plier jaw, means biasing the link pin extractor to an inward position toward the upper plier jaw, and means of releasably maintaining the link pin extractor within the lower plier jaw;

a multiple anvil comprising a multiple anvil disk having plural roller hole defined in spaced relationship about its periphery with the center of each hole concentric about the anvil disk to receive and support the roller and associated links of a roller chain, the multiple anvil disk being rotatably carried on an anvil mounting pin releasably and irrotatably carried by the lower plier jaw at a spaced distance from the pin extractor so that each roller hole may be rotated to a position with its center immediately sub-adjacent the extractor pin when the pin extractor be in relaxed biased position; and means of biasing the multiple anvil disk to any one of a plurality of positions with each roller hole operatively centered immediately below the relaxed pin extractor; and a chain chucker in the outer end parts of the plier jaws having indentations at similar opposed positions in the cooperating facing sides of the jaws to receive rollers at the end parts of a roller chain to be connected and force spaced links between the rollers into adjacency to allow their interconnection by a link pin responsive to plier motion.

5. The invention of claim 4 further characterized by:

the extractor pin cylinder having a rounded top with a larger annular spring boss immediately therebelow and a retaining ring groove defined in its lower part with a larger annular retaining ring therein;

a cylindrical compression spring carried about the extractor pin cylinder immediately below the spring boss; and an enlarged spring hole in the lower plate jaw to receive and support the compression spring to bias the extractor pin cylinder to an inward position.

6. The invention of claim 4 further characterized by the means of biasing the multiple anvil disk to plural positions comprising:

plural interfitting indentations and protuberances carried by the adjacent surfaces of the anvil disk and a head at the lowermost position of the anvil mounting pins; and mechanical means biasing the anvil disk against the anvil mounting pin head but allowing rotary motion between the parts by manual manipulation.

7. The invention of claim 4 further characterized by the plier jaws having a substantial length in excess of four inches from their communal pivot point to allow operation upon widely spaced chain links.

* * * * *